US007743462B2

(12) United States Patent
Yoo

(10) Patent No.: US 7,743,462 B2
(45) Date of Patent: Jun. 29, 2010

(54) DOUBLE SIDED SUCTION NOZZLE FOR USE IN VACUUM CLEANER

(75) Inventor: Dong-Hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 69 days.

(21) Appl. No.: 11/903,593

(22) Filed: Sep. 24, 2007

(65) Prior Publication Data

US 2008/0172818 A1 Jul. 24, 2008

Related U.S. Application Data

(60) Provisional application No. 60/897,145, filed on Jan. 24, 2007.

(30) Foreign Application Priority Data

Mar. 29, 2007 (KR) ..... 10-2007-0030640

(51) Int. Cl.
*A47L 5/22* (2006.01)

(52) U.S. Cl. ..... 15/385; 15/387; 15/375; 15/377

(58) Field of Classification Search ..... 15/385–387, 15/382, 375, 376, 380, 384, 389, 180, 182, 15/246.3
See application file for complete search history.

(56) References Cited

U.S. PATENT DOCUMENTS 6,748,622 B2 * 6/2004 Lee et al. ..... 15/320
6,792,648 B2 * 9/2004 Lee ..... 15/377
2003/0221281 A1 * 12/2003 Oh ..... 15/387
2004/0045126 A1 3/2004 Parker et al.

FOREIGN PATENT DOCUMENTS

| | | |
|---|---|---|
| CN | 1350829 | 5/2002 |
| CN | 1381218 | 11/2002 |
| EP | 1138243 | 10/2001 |
| EP | 1486156 | 12/2004 |
| JP | 4-56446 | 5/1992 |

(Continued)

OTHER PUBLICATIONS

Official Action dated Dec. 12, 2007 corresponding to Korean Patent Application No. 10-2007-0030640.
Extended European Search Report dated May 29, 2009 corresponding to European Patent Application No. 07291101.9-2316.

(Continued)

*Primary Examiner*—Dung Van Nguyen
(74) *Attorney, Agent, or Firm*—Ohlandt, Greeley, Ruggiero & Perle, L.L.P.

(57) ABSTRACT

A doubled sided suction nozzle having both a brush function and a duster function is disclosed. The doubled sided suction nozzle includes a nozzle body having an air inlet to draw in air, at least one brush unit rotatably disposed on a first surface of the nozzle body to come in surface contact with a surface to be cleaned thus to brush away dirt from the surface to be cleaned, at least one duster unit rotatably disposed on the second surface of the nozzle body to come in surface contact with the surface to be cleaned thus to wipe off the dust or dirt from the surface to be cleaned, and a rotating unit disposed in the nozzle body to rotate the brush unit and the duster unit.

11 Claims, 8 Drawing Sheets

FOREIGN PATENT DOCUMENTS

| | | |
|---|---|---|
| KR | 1995-010069 | 4/1995 |
| KR | 950010069 | 11/1995 |
| WO | 2004/073476 | 9/2004 |

OTHER PUBLICATIONS

Office Action dated Nov. 6, 2009 corresponding to Chinese Patent Application No. 200710163018.3.

* cited by examiner

DOUBLE SIDED SUCTION NOZZLE FOR USE IN VACUUM CLEANER

CROSS-REFERENCE TO RELATED APPLICATIONS

This application claims the benefit under 35 U.S.C. §119 of U.S. Provisional Patent Application No. 60/897,145, filed Jan. 24, 2007, in the United States Patent and Trademark Office, and Korean Patent Application No. 10-2007-0030640, filed on Mar. 29, 2007, in the Korean Intellectual Property Office, the entire content of both of which are hereby incorporated by reference.

BACKGROUND OF THE INVENTION

1. Field of the Invention

The present disclosure relates to a vacuum cleaner. More particularly, the present disclosure relates to a suction nozzle for use in a vacuum cleaner having a brush function, which brushes away dirt, such as dust or the like, from a surface to be cleaned, and a duster function, which wipes off dirt, such as stain or the like, from the surface to be cleaned.

2. Description of the Related Art

Generally, a vacuum cleaner draws in dirt from a surface to be cleaned thus to clean the surface to be cleaned by using a suction force generated by a suction motor. Such a vacuum cleaner is provided with a suction nozzle, which draws in the dirt from the surface to be cleaned when it moves while coming in contact with the surface to be cleaned. The suction nozzle usually has an air inlet to draw in the dirt adhered to the surface to be cleaned, and a fixed brush or a rotatable brush disposed adjacent the air inlet to brush off the dirt adhered to the surface to be cleaned.

However, such a conventional suction nozzle is advantageous in that it is effective to brush off and draw in dry dirt, such as dust or the like, adhered to a surface to be cleaned, such as a carpet or the like, but disadvantageous in that it is difficult to remove fixed dirt, such as stain, grime or the like, or wet dirt, such as liquid or the like, adhered to a slippery surface to be cleaned, such as a floor or the like.

To address the problems as described above, besides a main suction nozzle, the conventional vacuum cleaner provides an accessory suction nozzle, which is selectively mounted to a hose or an extended tube to perform only a duster action. However, in this case, there is a problem in that a user should selectively replace one of the main suction nozzle and the accessory suction nozzle with the other according to the kind or the condition of the surface to be cleaned.

To address the problem, a double sided brush assembly, which a pair of roller brushes for use in a carpet and a pair of roller brushes for use in a floor are mounted on upper and lower surfaces thereof to selectively clean the carpet or the floor without exchanging the brush assemblies in cleaning, is disclosed in Korean utility model No. 1995-10069. However, the double sided brush assembly presents a problem that since the two pairs of roller brushes having certain diameters are arranged on upper and lower surfaces, respectively, the entire volume thereof is enlarged. Also, when the brush assembly moves back and forth, the roller brushes rotate along the surface to be cleaned while coming in line contact therewith. Thus, the double sided brush assembly presents a problem that even though the roller brushes for use in the floor, which can clean the slippery surface to be cleaned, such as the floor or the like, are used, they do not completely remove the dirt, such as the stain, the grime or the like, firmly adhered to the surface to be cleaned therefrom.

SUMMARY OF THE INVENTION

The present disclosure has been developed in order to overcome the above drawbacks and other problems associated with the conventional arrangement. An aspect of the present disclosure is to provide a double sided suction nozzle for use in a vacuum cleaner in which a brush unit and a duster unit having a disc type brush and a disc type duster, respectively, are mounted on both surfaces of a nozzle body, thereby allowing the nozzle to reduce the volume thereof and to perform a brush function and a duster function without replacing the nozzles.

Another aspect of the present disclosure is to provide a double sided suction nozzle for use in a vacuum cleaner in which a brush unit and a duster unit having a disc type brush and a disc type duster, respectively, are configured to rotate while coming in surface contact with a surface to be cleaned, thereby improving a cleaning efficiency for dirt firmly stuck to the surface to be cleaned.

Further another aspect of the present disclosure is to provide a double sided suction nozzle for use in a vacuum cleaner in which even though a user does not move a nozzle body, a brush unit and a duster unit can be automatically operated, thereby allowing the user to easily clean a surface to be cleaned.

The above aspect and/or other feature of the present disclosure can substantially be achieved by providing a double sided suction nozzle, which includes a nozzle body having an air inlet to draw in air; at least one brush unit rotatably disposed on a first surface of the nozzle body to come in surface contact with a surface to be cleaned thus to brush away dirt from the surface to be cleaned; at least one duster unit rotatably disposed on a second surface of the nozzle body to come in surface contact with the surface to be cleaned thus to wipe off the dust or dirt from the surface to be cleaned; and a rotating unit disposed in the nozzle body to rotate the brush unit and the duster unit.

Here, the brush unit may include a brush plate rotatably disposed on the first surface of the nozzle body, and a brush detachably adhered to the brush plate, and the duster unit may include a duster plate rotatably disposed on the second surface of the nozzle body, and a duster detachably adhered to the duster plate. At this time, preferably, but not necessarily, the brush plate and the duster plate include disc type plates disposed parallel to the surface to be cleaned, respectively.

The rotating unit may include a rotating force-generating unit to generate a rotating force, and at least one rotating force-transmitting unit to transmit the rotating force of the rotating force-generating unit to the brush unit and the duster unit. At this time, preferably, but not necessarily, the rotating force-generating unit includes a fan rotatably disposed in the nozzle body to rotate by means of drawn-in air, and the rotating force-transmitting unit includes a worm disposed on a rotating axis of the fan, and a worm wheel engaged with the worm and having rotating axes, which are projected from both ends thereof and to which the brush plate and the duster plate are fixed, respectively.

In an exemplary embodiment of the present disclosure, preferably, but not necessarily, each of the brush unit, the duster unit and the rotating force-transmitting unit are formed in pairs, and the worm and the worm wheel of each rotating force-transmitting unit are configured, so that the worm and the worm wheel are rotated in a direction, which allows the brush plate and the duster plate to rotate in a direction of facing the air inlet.

In accordance with another aspect of the present disclosure, the rotating force-transmitting unit may include a driving bevel gear disposed on a rotating axis of the fan, and a driven bevel gear engaged with the driving bevel gear and having rotating axes, which are projected from both ends thereof and to which the brush plate and the duster plate are fixed, respectively.

In accordance with further another aspect of the present disclosure, the rotating force-generating unit may include a motor disposed in the nozzle body, and the rotating force-transmitting unit may include a rod member having a driven gear to receive a driving force from a driving gear formed on a driving axis of the motor, a worm disposed on the rod member, and a worm wheel engaged with the worm, and having rotating axes, which are projected from both ends thereof and to which the brush plate and the duster plate are fixed, respectively.

In accordance with still another aspect of the present disclosure, the rotating force-generating unit may include a motor disposed in the nozzle body, and the rotating force-transmitting unit may includes a rod member having a driven gear to receive a driving force from a driving gear formed on a driving axis of the motor, a driving bevel gear disposed on the rod member, and a driven bevel gear engaged with the driving bevel gear and having rotating axes, which are projected from both ends thereof and to which the brush plate and the duster plate are fixed, respectively.

Other objects, advantages and salient features of the disclosure will become apparent from the following detailed description, which, taken in conjunction with the annexed drawings, discloses preferred embodiments of the disclosure.

BRIEF DESCRIPTION OF THE DRAWINGS

These and/or other aspects and advantages of the disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, a double sided suction nozzle for use in a vacuum cleaner according to certain exemplary embodiments of the present disclosure will be described in detail with reference to the accompanying drawings.

Figure 8:
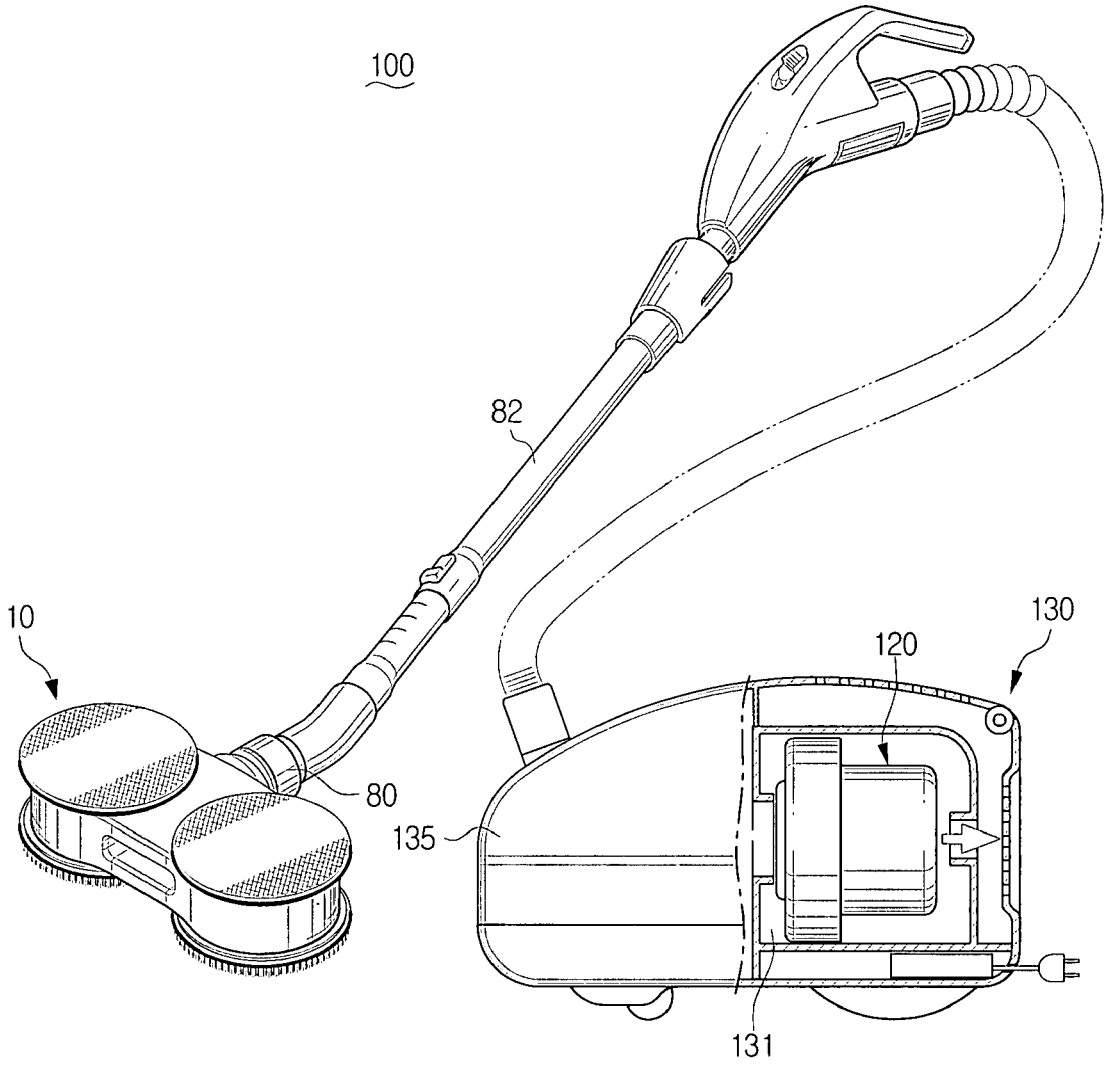
FIG. 8 is a perspective view exemplifying a vacuum cleaner to which the double sided suction nozzle illustrated in FIG. 1 is applied.

FIG. 8 is a perspective view exemplifying a vacuum cleaner 100 to which a double sided suction nozzle 10 according to the exemplary embodiment of the present disclosure is applied.

Referring to FIG. 8, the vacuum cleaner 100 includes a double sided suction nozzle 10 to draw in air laden with dirt, an extended tube part 82 to communicate the double sided suction nozzle 10 with a cleaner body 130, and a cleaner body 130 divided into a dust collecting chamber 135 and a motor chamber 131.

Figure 1:
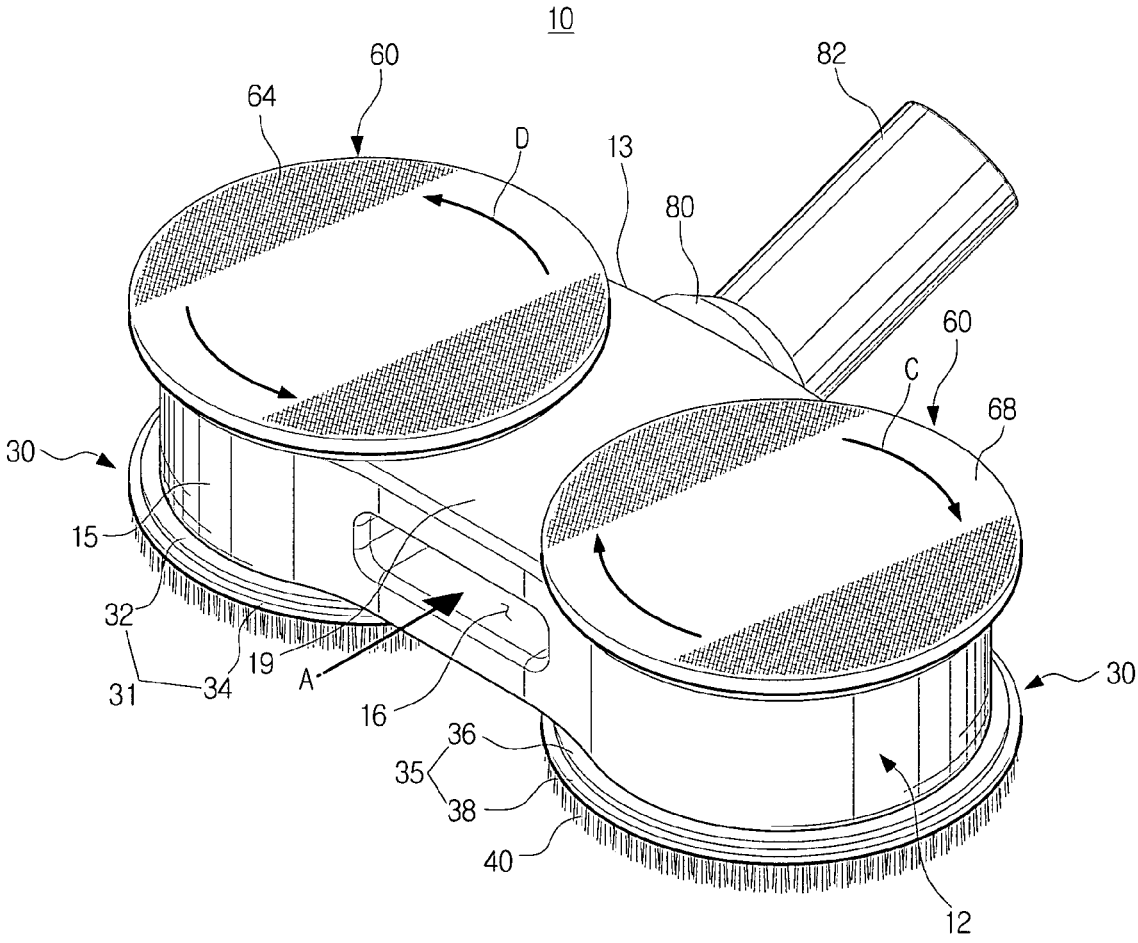
FIG. 1 is a perspective view exemplifying a double sided suction nozzle for use in a vacuum cleaner according to an exemplary embodiment of the present disclosure when brushes come in contact with a surface to be cleaned.
Figure 2:
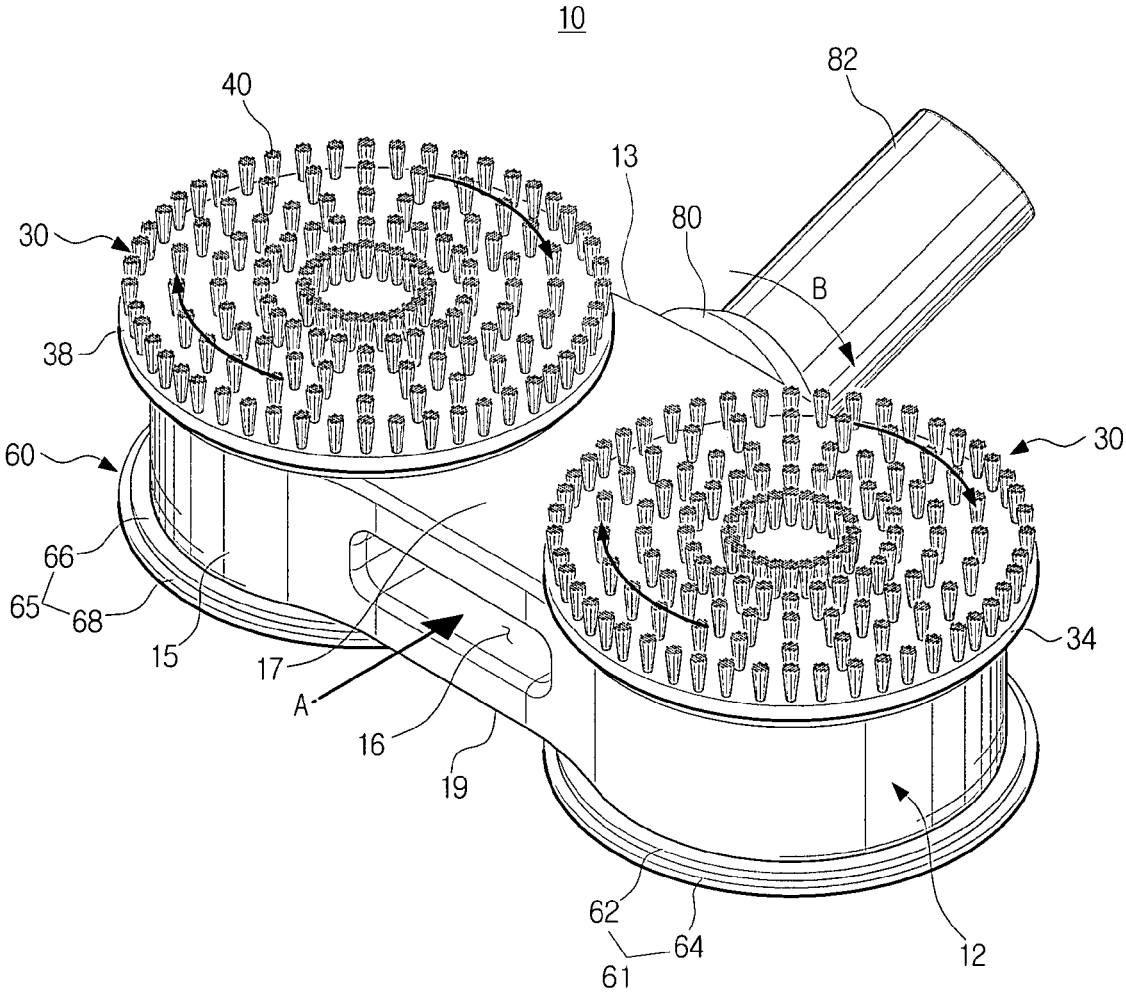
FIG. 2 is a perspective view exemplifying the double sided suction nozzle of FIG. 1 when dusters come in contact with the surface to be cleaned.

FIGS. 1 and 2 are perspective views exemplifying the double sided suction nozzle 10 for use in the vacuum cleaner according to the exemplary embodiment of the present disclosure. Particularly, FIG. 1 is a view exemplifying a state where brushes 34 and 38 come in contact with a surface to be cleaned to brush away dirt, such as dust, adhered to the surface to be cleaned, and FIG. 2 is a view exemplifying a state where dusters 64 and 68 come in contact with the surface to be cleaned to wipe off dirt, such as stain or spot, stained to the surface to be cleaned.

Referring to FIGS. 1 and 2, the double sided suction nozzle 10 according to the exemplary embodiment of the present disclosure includes a nozzle body 12, a rotating unit 50 (see FIG. 3), a brush unit 30, a duster unit 60 and a nozzle connector 80.

In the nozzle body 12 is disposed the rotating unit 50. The nozzle body 12 has the nozzle connector 80 formed on a rear surface thereof, so that it is connected with an extended tube part 82 of a vacuum cleaner 100.

An air inlet 16 is formed in the middle of a front surface 15 of the nozzle body 12, and air laden with dust or dirt is drawn in through the air inlet 16 and then flown into a cleaner body 130 through the nozzle connector 80 and the extended tube part 82. Here, although the air inlet 16 is illustrated and explained as formed in the middle of the front surface 15 of the nozzle body 12, it can be formed on other portions, for example, in upper and lower surfaces of the nozzle body 12, which can increase a dust drawing-in efficiency.

Figure 3:
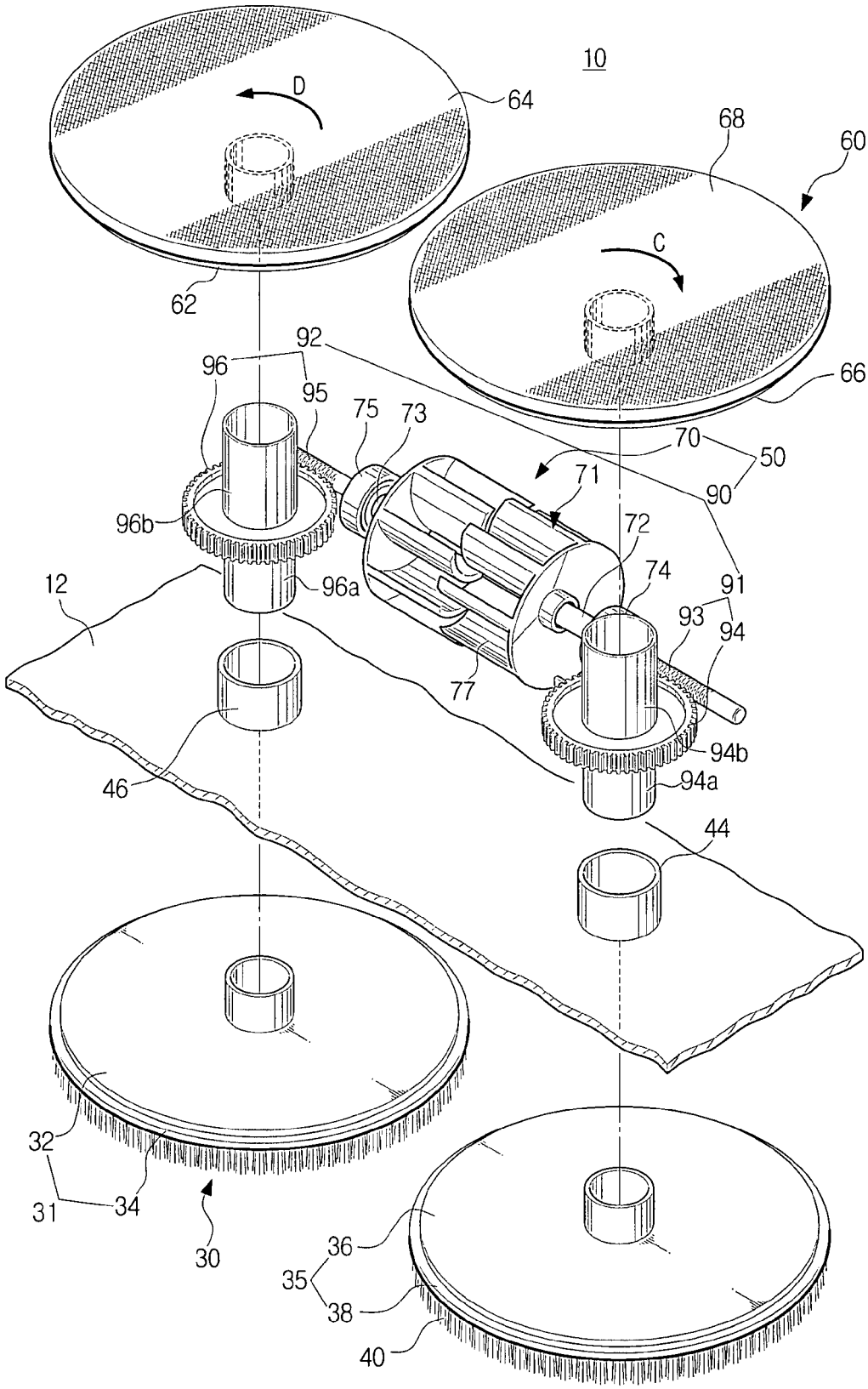
FIG. 3 is an exploded view partially exemplifying the double sided suction nozzle of FIG. 1.

Referring to FIG. 3, the rotating unit 50 includes a rotating force-generating unit 70 to generate a rotating force, and a rotating force-transmitting unit 90 to transmit the rotating force generated by the rotating force-generating unit 70 to the brush unit 30 and the duster unit 60.

The rotating force generating unit 70 is made up of a fan 71 disposed on an air passage in the nozzle body 12 to rotate by means of the air drawn in through the air inlet 16. In case that the rotating force-generating unit 70 is made up of the fan 71 as described above, the fan 71 can be operated by the air drawn in through the air inlet 16 without a separate power supply.

The fan 71 includes a wing 77, and first and second rotating axes 72 and 73 projected from rotating centers of both ends of the wing 77. The first and the second rotating axes 72 and 73 are rotatably supported in the nozzle body 12, so that the fan 71 is transversely disposed to the air inlet 16 of the nozzle body 12. At this time, it is preferable that the first and the second rotating axes 72 and 73 are supported by ball bearings 74 and 75, respectively.

The rotating force-transmitting unit 90 is made up of a worm and a worm wheel, which have a large gear ratio to each other. To transmit the driving force of the first and the second rotating axes 72 and 73 of the fan 71, the double sided suction nozzle 10 according to the exemplary embodiments of the present disclosure is provided with first and second rotating force-transmitting units 91 and 92. As illustrated in FIGS. 3 and 4, the first rotating force-transmitting unit 91 includes a first worm 93 formed on the first rotating axis 72 of the fan 71, and a first worm wheel 94 engaged with the first worm 93. The first worm wheel 94 is disposed to rotate parallel to the nozzle body 12. The second rotating force-transmitting unit 92 is symmetrically disposed to the first rotating force-transmitting unit 91 about the fan 71. The second rotating force-transmitting unit 92 includes a second worm 95 formed on the second rotating axis 73 of the fan 71, and a second worm wheel 96 engaged with the second worm 95. The second worm wheel 96 is disposed to rotate parallel to the nozzle body 12. At this time, the first and the second worm wheels 94 and 96 at first and second rotating axes 94*a*, 96*a*; and 94*b*, 96*b* thereof are rotatably supported by first and second upper supporting members (not illustrated) and first and second lower supporting members 44 and 46, such as bearings or bushes, disposed on the nozzle body 12, respectively. Also, the first worm 93 and the first worm wheels 94 and the second worm 95 and the second worm wheel 96 can use worms and worm wheels, which are formed to rotate first and second brush units 35 and 31 and first and second duster units 65 and 61 to be describe later in opposite directions to each other, respectively. For instance, the first worm 93 and the first worm wheels 94 use a worm and a worm wheel, which are formed to rotate the first brush unit 35 and the first duster unit 65 in a clockwise direction (a direction of arrow C of FIGS. 1 and 3), and the second worm 95 and the second worm wheel 96 use a worm and a worm wheel, which are formed to rotate the second brush unit 31 and the second duster unit 61 in a counterclockwise direction (a direction of arrow D of FIGS. 1 and 3). If the first and the second worms 93 and 95 and the first and the second worm wheel 94 and 96 are formed in the configuration as described above, the first and the second worm wheel 94 and 96 are rotated in opposite direction to each other by the rotation of the fan 71. As a result, the first and the second brush units 35 and 31 and the first and the second duster units 65 and 61, which are connected to the first and the second rotating axes 94*a*, 96*a* and 94*b*, 96*b* of the first and the second worm wheel 94 and 96, are rotated in opposite direction to each other while facing the air inlet 16, respectively, as illustrated in FIGS. 1 and 2. Thus, the dirt brushed off by the first and the second brush units 35 and 31 and dirt wiped off by the first and the second duster units 65 and 61 can be gathered toward the air inlet 16 and then drawn in through the air inlet 16.

The brush unit 30, which brushes away dry dirt, such as dust, hair, etc., is made of first and second brush units 35 and 31. The first and second brush units 35 and 31 are rotatably installed on a first surface 17 of the nozzle body 12, and are made up of first and second brush plates 36 and 32 and first and second brushes 38 and 34, respectively.

The first and the second brush plates 36 and 32 are fixedly connected to the first rotating axes 94*a* and 96*a* of the first and the second worm wheels 94 and 96 of the first and the second rotating force-transmitting units 91 and 92 disposed in the nozzle body 12, by screws, keys, etc., respectively. The first and the second brush plates 36 and 32 are symmetrically disposed on the first surface 17 of the nozzle body 12. Preferably, but not necessarily, the first and the second brush plates 36 and 32 are formed of disc type plates, respectively.

The first and the second brush 38 and 34 have a plurality of protrusions or furs 40 formed on one side surface thereof, and is formed of a material, for example, a rubber, having good electricity and mountable on or dismountable from the first and the second brush plates 36 and 32 thus to replace after use and in abrasion. In addition, preferably, but not necessarily, the first and the second brush 38 and 34 have diameters slightly larger than those of the first and the second brush plates 36 and 32, respectively. Thus, as illustrated in FIG. 1, when the first and the second brush 38 and 34 are mounted on the first and the second brush plates 36 and 32, outer circumferential surfaces of the first and the second brush 38 and 34 are slightly projected beyond outer circumferential surfaces of the first and the second brush plates 36 and 32, respectively, and the plurality of protrusions or furs 40 comes to face the surfaces to be cleaned. The fixations between the first and the second brush 38 and 34 and the first and the second brush plates 36 and 32 may be performed by using a method of wrap the first and the second brush plates 36 and 32 with the first and the second brushes 38 and 34, respectively, or using separate fixing means, such as hooks and book-accommodating grooves.

The duster unit 60, which wipes off dirt, such as stain, the spot, etc., firmly adhered to the surface to be cleaned, is made up of first and second duster units 65 and 61. The first and the second duster units 65 and 61 are rotatably disposed on the nozzle body 12, and are made up of first and second duster plates 66 and 62 and first and second dusters 68 and 64, respectively. The first and the second duster plates 66 and 62 have the same diameters as those of the first and the second brush plates 36 and 32, respectively, and the first and the second dusters 68 and 64 have the same diameters as those of the first and the second brushes 38 and 34, respectively. The first and the second duster plates 66 and 62 are rotatably disposed on a second surface 19 of the nozzle body 12 on which the brush unit 30 is installed, and are fixedly connected to the second rotating axes 94*b* and 96*b* of the first and the second worm wheels 94 and 96 of the first and the second rotating force-transmitting units 91 and 92 to receive rotating forces of the second rotating axes 94*b* and 96*b* and thus to rotate thereby. To replace after use and in abrasion, preferably, but not necessarily, the first and the second dusters 68 and 64 are installed, so that they can be mounted on and dismounted from the first and the second duster plates 66 and 62. The fixations between the first and the second dusters 68 and 64 and the first and the second duster plates 66 and 62 may be performed by using a method of wrap the first and the second duster plates 66 and 62 with the first and the second dusters 68 and 64, respectively, or using separate fixing means, such as magic tapes. In addition, the first and the second duster plates 66 and 62 may be formed of a fabric material, such as a cloth or the like, which can scrub a slippery surface to be cleaned, such as a floor or the like.

The nozzle connector 80, which allows the nozzle body 12 to rotate in an angle of 360 degrees, is installed in the rear of the nozzle body 12. Also, the extended tube part 82 of the vacuum cleaner 100 is connected to the nozzle connector 80. Accordingly, if a user rotates the nozzle body 12 with the extended tube 82 in her or his hands, the nozzle body 12 is rotated in a state as illustrated in FIG. 1 or FIG. 2 by the nozzle connector 80.

Hereinafter, an operation of the double sides suction nozzle 10 for use in the vacuum cleaner 100 constructed as described above will be explained in detail with reference to FIGS. 1 through 4 and 8.

First, to cleaner dirt, such as dust or the like, adhered to the surface to be cleaned, the user sets the vacuum cleaner 100 working while bringing the brush unit 30 in contact with the surface to be cleaned.

Then, the suction motor 120 of the vacuum cleaner 130 is operated to generate a suction force, and thus air is drawn in through the air inlet 16 of the nozzle body 12. The air drawn in through the air inlet 16 rotates the fan 71, the both ends of which are supported on the air passage in the nozzle body 12 by the ball bearings 74 and 75. As the fan 71 is rotated, the first and the second worms 93 and 95 formed on the rotating axes 72 and 73 of the fan 71 are rotated along with the fan 71. As the first and the second worms 93 and 95 are rotated, the first and the second worm wheels 94 and 96 engaged with the first and the second worms 93 and 95 are rotated. As the first and the second worm wheels 94 and 96 are rotated, the first and the second brush units 35 and 31 fixed on the first rotating axes 94*a* and 96*a* of the first and the second worm wheels 94 and 96 are also rotated. At this time, the first worm 93 and the first worm wheels 94 and the second worm 95 and the second worm wheel 96 are formed of the worms and worm wheels, which allows the first and the second brush units 35 and 31 and the first and the second duster units 65 and 61 to rotate in opposite directions to each other, respectively. Accordingly, the first worm wheel 94 and the second worm wheel 96 are rotated in opposite directions to each other, so that the first and the second brush units 35 and 31 and the first and the second duster units 65 and 61 rotates in opposite directions to each other while facing the air inlet 16, respectively, as illustrated in FIG. 1. That is, if the first worm wheel 94 is rotated in a clockwise direction (a direction of arrow C of FIGS. 1 and 3), the second worm wheel 96 is rotated in a counterclockwise direction (a direction of arrow D of FIGS. 1 and 3).

As a result, the first and the second brush plates 36 and 32 and the first and the second brushes 38 and 34 mounted thereon are rotated in the clockwise and counterclockwise directions, respectively, and thus the protrusions or furs 40 of the first and the second brushes 38 and 34 scrape off the dirt adhered to the surface to be cleaned toward the air inlet 16 and the scraped-off dirt is drawn into the air inlet 16 (in a direction of arrow A of FIG. 1).

After the dirt, such as the dust or the like, is cleaned from the surface to be cleaned as described above, to clean dirt, such as stain or the like, stained in the surface to be cleaned, the user rotates the nozzle body 12 in a direction of arrow B of FIG. 2 to the extended tube part 82 thus to allow the duster unit 60 to face the surface to be cleaned, as illustrated in FIG. 2. As a result, the dirt is removed from the surface to be cleaned by the rotation of the duster unit 60, and then the duster cleaning operation is completed. The used first and second dusters 68 and 64 and the used first and second brush 38 and 34 can be cleaned after dismounted from the first and the second duster plates 36 and 32 and the first and the second brush plates 66 and 62, and then used again after mounted thereon, respectively.

Figure 4:
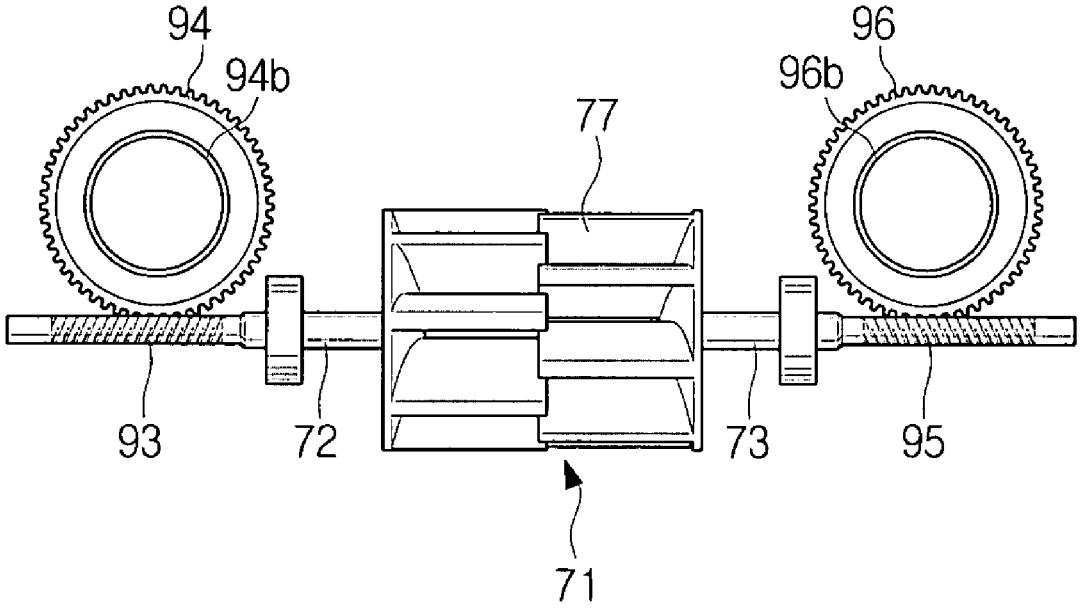
FIG. 4 is a top plan view exemplifying a rotating unit of the double sided suction nozzle illustrated in FIG. 3.
Figure 5:
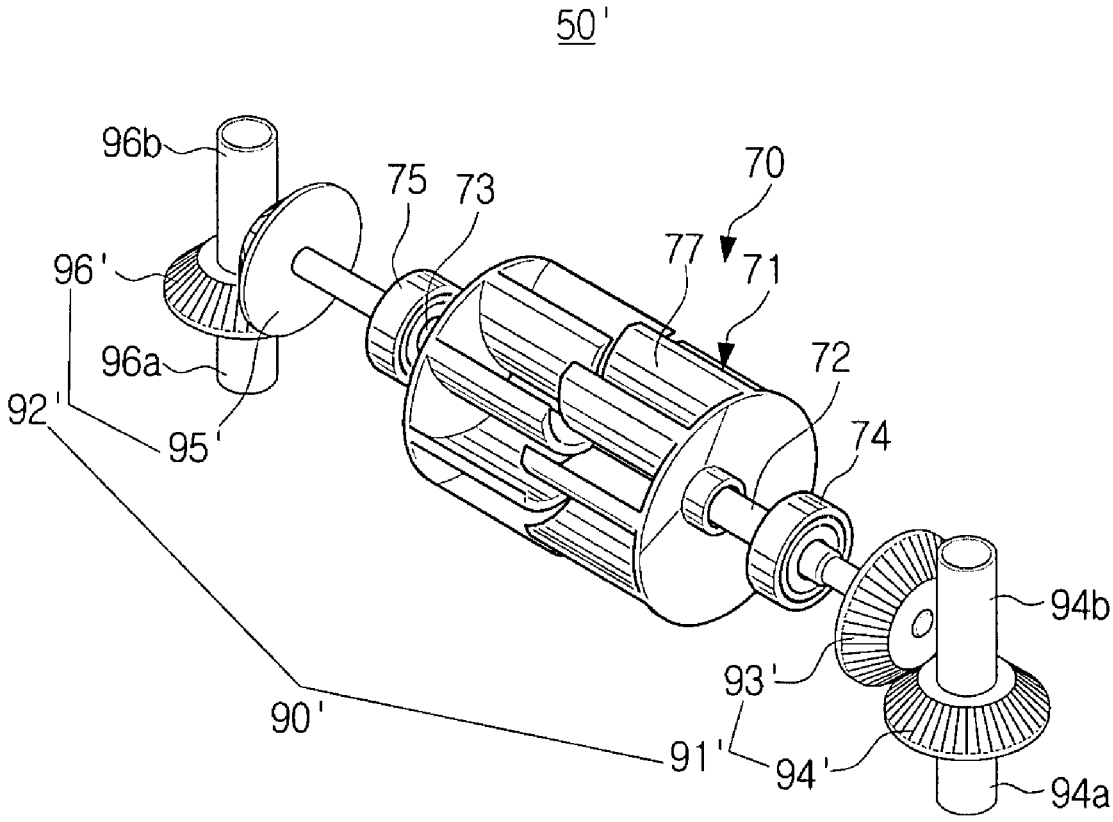
FIG. 5 is a perspective view exemplifying another exemplary embodiment of the rotating unit of the double sided suction nozzle illustrated in FIG. 3.

FIG. 5 is a perspective view exemplifying another exemplary embodiment of the rotating unit 50' of the double sided suction nozzle 10 according to the present disclosure. Constructions of the rotating unit 50' is the same as those of the rotating unit 50 illustrated in FIGS. 3 and 4 except a rotating force-transmitting unit 90'. Accordingly, a description on the constructions of the rotating unit 50' except the rotating force-transmitting unit 90' will be omitted. The rotating force-transmitting unit 90' is made up of first and second rotating force-transmitting unit 91' and 92'.

The first rotating force-transmitting unit 91' includes a first driving bevel gear 93' disposed on the first rotating axis 72 of the fan 71, and a first driven bevel gear 94' engaged with the first driving bevel gear 93'. The first driven bevel gear 94' is installed to rotate parallel to the nozzle body 12. The second rotating force-transmitting unit 92' is symmetrically disposed to the first rotating force-transmitting unit 91' about the fan 71. The second rotating force-transmitting unit 92' includes a second driving bevel gear 95' disposed on the second rotating axis 73 of the fan 71, and a second driven bevel gear 96' engaged with the second driving bevel gear 95'. The second driven bevel gear 96' is installed to rotate parallel to the nozzle body 12.

Since an operation of the rotating force-transmitting unit 90' constructed as described above is the same as that of the rotating unit 50 illustrated in FIGS. 3 and 4 except that the first and second driving/driven bevel gears are used, a detailed description thereof will be omitted.

Figure 6:
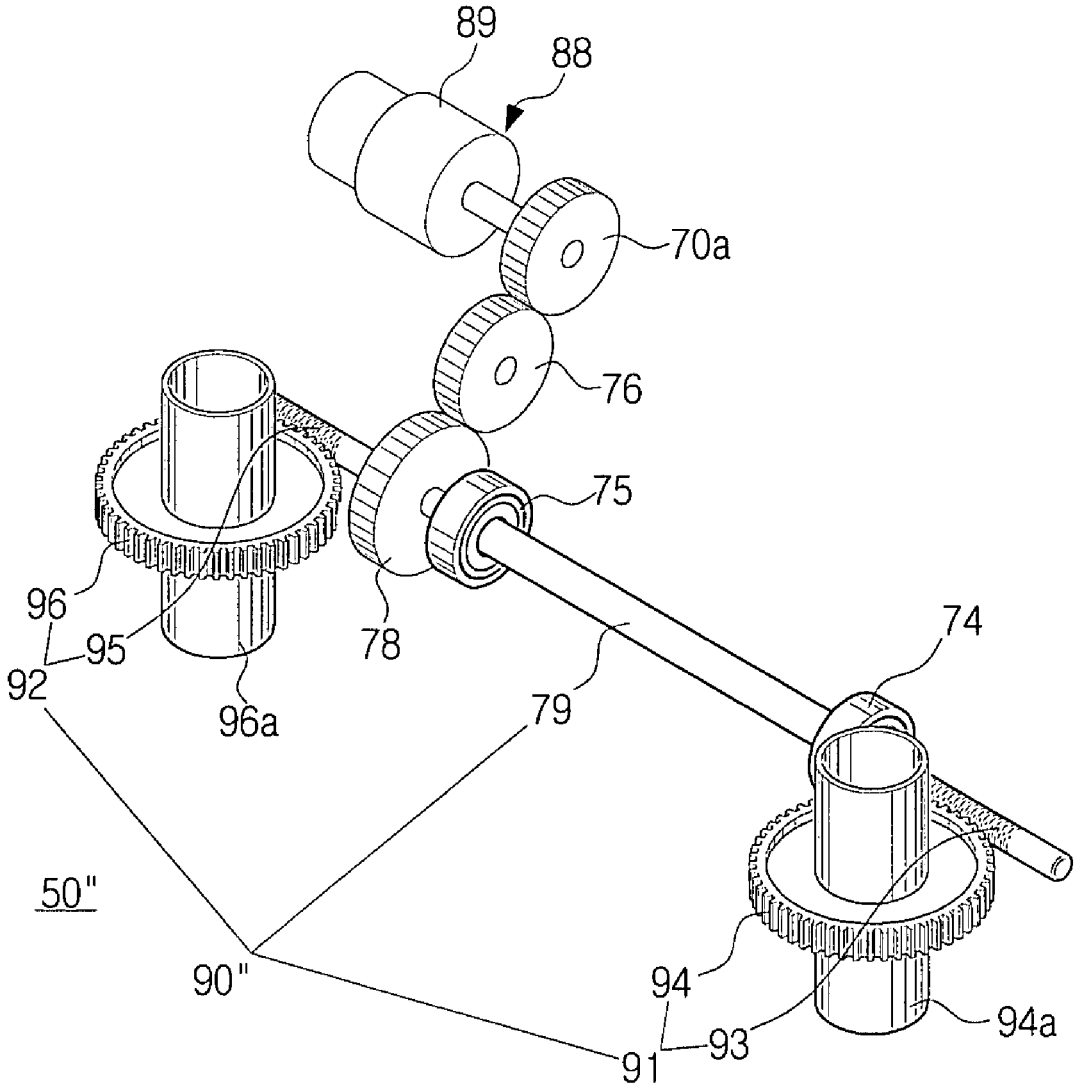
FIG. 6 is a perspective view exemplifying further another exemplary embodiment of the rotating unit of the double sided suction nozzle illustrated in FIG. 3.

FIG. 6 is a perspective view exemplifying further another exemplary embodiment of the rotating unit 50" of the double sided suction nozzle 10 according to the present disclosure. The rotating unit 50" has a rotating force-generating unit 88 and a rotating force-transmitting unit 90".

The rotating force-generating unit 88 is provided with a motor 89 installed in the nozzle body 12. In this case, the suction nozzle 10 is disadvantageous in that there is required a separate power source and it is weighted, but advantageous in that the duster plates 62 and 66 and the brush plates 32 and 36 can be separately operated from the vacuum cleaner 100.

The rotating force-transmitting unit 90" includes first and second rotating force-transmitting units 91 and 92 and a rod member 79. Since constructions of the first and the second rotating force-transmitting units 91 and 92 except the rod member 79 are the same as those of the rotating unit 50 explained with reference to FIGS. 3 and 4, a detailed description thereof will be omitted. The rod member 79 has a driven gear 78, which receives a driving force through an idle gear 76 from a driving axis 70*a* of the motor 89. Like the first and the second rotating axes 72 and 73 of the fan 71 of the rotating force-generating unit 70 illustrated in FIGS. 3 and 4, it is preferable that the rod member 79 is supported by the ball bearings 74 and 75.

Since an operation of the rotating unit 50" constructed as described above is the same as that of the rotating unit 50 illustrated in FIGS. 3 and 4 except that the rotating force is generated by the motor 89 instead of the fan 71, a detailed description thereof will be omitted.

Figure 7:
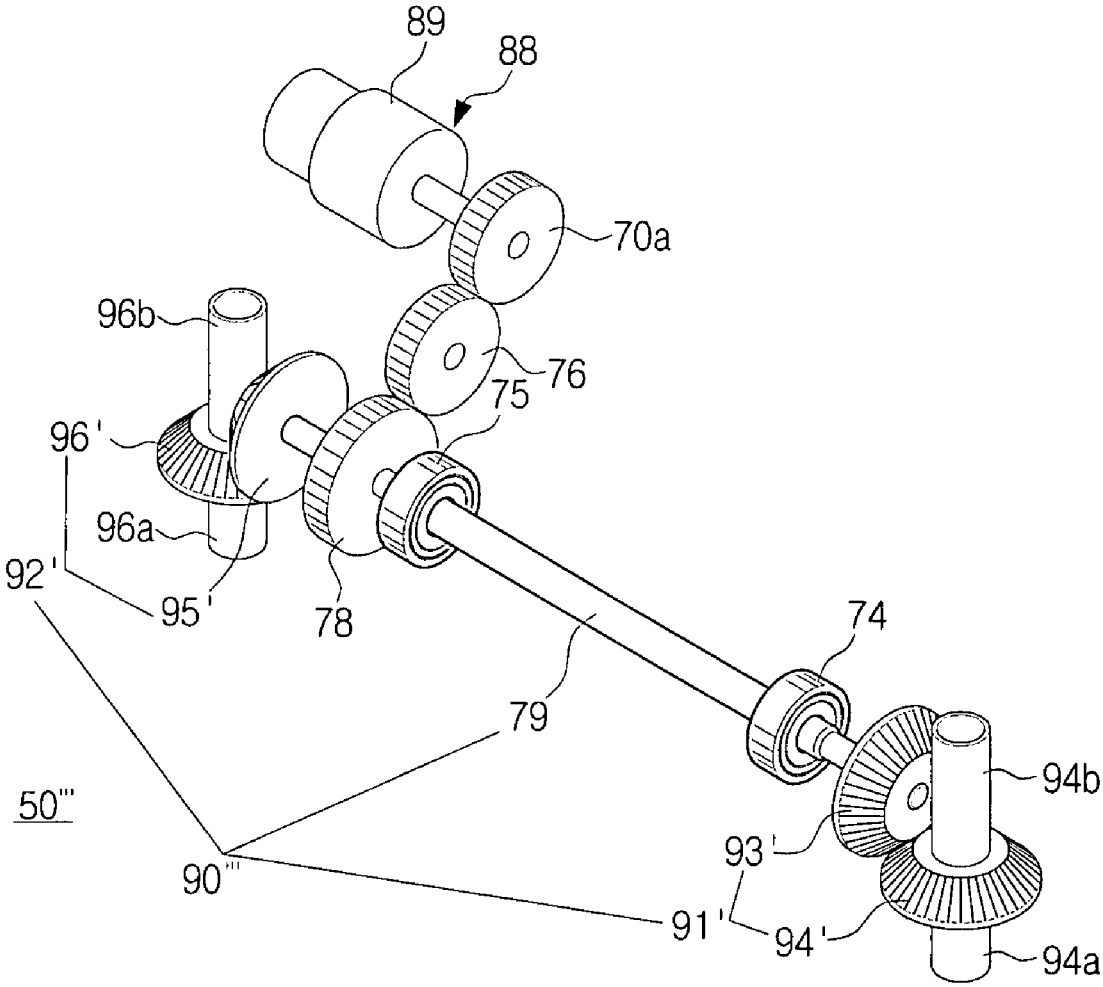
FIG. 7 is a perspective view exemplifying still another exemplary embodiment of the rotating unit of the double sided suction nozzle illustrated in FIG. 3.

FIG. 7 is a perspective view exemplifying still another exemplary embodiment of the rotating unit 50'" of the double sided suction nozzle 10 according to the present disclosure. The rotating unit 50'" has a rotating force-generating unit 88 and a rotating force-transmitting unit 90'".

Construction and operation of the rotating force-generating unit 88 are the same as those of the rotating force-generating unit 88 illustrated in FIG. 6, and construction and operation of the rotating force-transmitting unit 90'" are the same as those of the rotating force-transmitting unit 90" illustrated in FIG. 6 except that first and second rotating force-generating unit 91' and 92' as illustrated in FIG. 5 are installed on both sides of the rod member 79, respectively. Accordingly, a description on the constructions and the operations thereof will be omitted.

As apparent from foregoing description, according to the exemplary embodiment of the present disclosure, the double sided suction nozzle for use in the vacuum cleaner is configured, so that the brush unit and the duster unit having the disc type brushes and the disc type dusters, respectively, are attached on upper and lower surfaces of the nozzle body, thereby allowing the nozzle to reduce the volume thereof and allowing the user to selectively use the brush function and the duster function without the replacement thereof only by the simple action of rotating the nozzle body according to the kind and the condition of the surface to be cleaned.

Further, according to the exemplary embodiment of the present disclosure, the double sided suction nozzle for use in the vacuum cleaner is configured, so that the brush unit and the duster unit are disposed parallel to the surface to be cleaned thus to come in surface contact with the surface to be cleaned and rotated in a vertical state to the surface to be cleaned. Accordingly, when the user moves the nozzle body back and forth, the brush unit and the duster unit are not rotated along the surface to be cleaned while coming in line contact therewith, like the conventional roller brush. Thus, the dirt, such as the stain or the like, as well as the dirt, such as the dust or the like, firmly stuck to the surface to be cleaned can be easily cleaned.

Also, according to the exemplary embodiment of the present disclosure, the double sided suction nozzle for use in the vacuum cleaner is configured, so that the brush unit and the duster unit are automatically rotated by the air draw in through the air inlet or the motor. Accordingly, even though the user does not move the nozzle body back and forth, the brush unit and the duster unit can scrape off or wipe off the dirt adhered to the surface to be cleaned, thereby allowing the user to easily clean the surface to be cleaned.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the disclosure.

What is claimed is:

1. A double sided suction nozzle, comprising:

a nozzle body having an air inlet to draw in air;

at least one brush unit rotatably disposed on a first surface of the nozzle body to come in surface contact with a surface to be cleaned thus to brush away dirt from the surface to be cleaned;

at least one duster unit rotatably disposed on a second surface of the nozzle body to come in surface contact with the surface to be cleaned thus to wipe off the dust or dirt from the surface to be cleaned, the second surface being opposite the first surface; and a rotating unit disposed in the nozzle body to rotate the brush unit and the duster unit.

2. The double sided suction nozzle of claim 1, wherein the brush unit comprises a brush plate rotatably disposed on the first surface of the nozzle body, and a brush detachably adhered to the brush plate, and wherein the duster unit comprises a duster plate rotatably disposed on the second surface of the nozzle body, and a duster detachably adhered to the duster plate.

3. The double sided suction nozzle of claim 2, wherein the brush plate and the duster plate comprises disc type plates disposed parallel to the surface to be cleaned, respectively.

4. The double sided suction nozzle of claim 1, wherein the rotating unit comprises:

a rotating force-generating unit to generate a rotating force; and at least one rotating force-transmitting unit to transmit the rotating force of the rotating force-generating unit to the brush unit and the duster unit.

5. The double sided suction nozzle of claim 4, wherein the rotating force-generating unit comprises a fan rotatably disposed in the nozzle body to rotate by drawn-in air.

6. The double sided suction nozzle of claim 5, wherein the rotating force-transmitting unit comprises:

a worm disposed on a rotating axis of the fan; and a worm wheel engaged with the worm and having rotating axes, which are projected from both ends thereof and to which the brush plate and the duster plate are fixed, respectively.

7. The double sided suction nozzle of claim 6, wherein each of the brush unit, the duster unit and the rotating force-transmitting unit are formed in pairs, and wherein the worm and the worm wheel of each rotating force-transmitting unit is configured; so that the worm and the worm wheel are rotated in a direction, which allows the brush plate and the duster plate to rotate in a direction facing the air inlet.

8. The double sided suction nozzle of claim 5, wherein the rotating force-transmitting unit comprises:

a driving bevel gear disposed on a rotating axis of the fan; and a driven bevel gear engaged with the driving bevel gear and having rotating axes, which are projected from both ends thereof and to which the brush plate and the duster plate are fixed, respectively.

9. The double sided suction nozzle of claim 4, wherein the rotating force-generating unit comprises a motor disposed in the nozzle body.

10. The double sided suction nozzle of claim 9, wherein the rotating force-transmitting unit comprises:

a rod member having a driven gear to receive a driving force from a driving gear formed on a driving axis of the motor;

a worm disposed on the rod member; and a worm wheel engaged with the worm, and having rotating axes, which are projected from both ends thereof and to which the brush plate and the duster plate are fixed, respectively.

11. The double sided suction nozzle of claim 9, wherein the rotating force-transmitting unit comprises:

a rod member having a driven gear to receive a driving force from a driving gear formed on a driving axis of the motor;

a driving bevel gear disposed on the rod member; and a driven bevel gear engaged with the driving bevel gear and having rotating axes, which are projected from both ends thereof and to which the brush plate and the duster plate are fixed, respectively.

* * * * *